US005449164A

United States Patent [19]

Quesnel et al.

[11] Patent Number: 5,449,164

[45] Date of Patent: Sep. 12, 1995

[54] SHEET INVERTER APPARATUS

[75] Inventors: Lisbeth S. Quesnel, Pittsford; Paul J. DeGruchy, Hilton, both of N.Y.

[73] Assignee: Xerox Corporation, Stamford, Conn.

[21] Appl. No.: 297,331

[22] Filed: Aug. 29, 1994

[51] Int. Cl.[6] ..... B65H 29/00

[52] U.S. Cl. ..... 271/186; 271/270; 271/902

[58] Field of Search ..... 271/225, 186, 65, 902, 271/270

[56] References Cited

U.S. PATENT DOCUMENTS

| | | | |
|---|---|---|---|
| 3,416,791 | 12/1968 | Beckman, Jr. et al. | 271/65 |
| 4,928,127 | 5/1990 | Stemmle | 346/160 |
| 5,033,731 | 7/1991 | Looney | 271/176 |
| 5,106,075 | 4/1992 | Wafford et al. | 271/186 |
| 5,186,453 | 2/1993 | Kühnert | 271/270 |
| 5,317,377 | 5/1994 | Rubscha et al. | 355/319 |

FOREIGN PATENT DOCUMENTS

| | | | |
|---|---|---|---|
| 3718219 | 12/1987 | Germany | 271/186 |
| 113069 | 7/1983 | Japan | 271/65 |
| 97957 | 6/1984 | Japan | 271/65 |
| 269850 | 11/1987 | Japan | 271/225 |
| 275366 | 11/1989 | Japan | 271/186 |
| 200661 | 9/1991 | Japan | 271/186 |
| 246055 | 9/1992 | Japan | 271/186 |

OTHER PUBLICATIONS

European Patent Application Publication No. 0 402 836 A2.

*Primary Examiner*—H. Grant Skaggs

[57] ABSTRACT

A full productivity, tri-roll inverter for reversing the lead and trail edges of a sheet includes an input nip and an output nip positioned to feed sheets at a machine's process speed into and out of a chute and a reversing roll nip positioned in a predetermined position along the chute closely adjacent to but downstream of the input and output nips and adapted to open and allow a sheet to be driven into the chute by the input nip and closed to drive a sheet into the output nip. After a first sheet is captured by the output nip, the reversing roll nip is opened and a second sheet is driven into the chute by the input nip while the first sheet is simultaneously being pulled out of the chute by the output nip.

17 Claims, 7 Drawing Sheets

SHEET INVERTER APPARATUS

BACKGROUND OF THE INVENTION

This invention relates to an apparatus for exchanging lead and trail edges of sheets, and more particularly, to an improved full productivity, process speed sheet inverter apparatus that feeds a sheet into the inverter while simultaneously feeding a sheet out of the inverter at process speed.

Although a sheet inverter is referred to in the copier/printer art as an "inverter", its function is not necessarily to immediately turn the sheet over (i.e., exchange one face for the other). Its function is to effectively reverse the sheet orientation in its direction of motion. That is, to reverse the lead and trail edge orientation of the sheet. In typical inverters, the sheet is driven or fed by feed rollers or other suitable sheet driving mechanisms into a sheet reversing chute. By then reversing the motion of the sheet within the chute and feeding it back out from the chute, the desired reversal of the leading and trailing edges of the sheet in the sheet path is accomplished. Depending on the location and orientation of the inverter in a particular sheet path, this may, or may not, also accomplish the inversion (turning over) of the sheet. In some applications, for example, where the "inverter" is located at the corner of a 90° to 180° inherent bend in the copy sheet path, the inverter may be used to actually prevent inverting of a sheet at that point, i.e., to maintain the same side of the sheet face-up before and after this bend in the sheet path. On the other hand, if the entering and departing path of the sheet, to and from the inverter, is in substantially the same plane, the sheet will be inverted by the inverter. Thus, inverters have numerous applications in the handling of either original documents or copy sheets to either maintain or change the sheet orientation.

In the field of reprographic machines, it is often necessary to feed a copy sheet leaving the processor of the machine along one of two alternate paths, particularly when the machine can selectively produce simplex (one-sided) and duplex (two-sided) sheets. Simplex sheets may be fed directly to an output tray, whereas the duplex sheets may pass to a sheet feeder which automatically reverses the direction of movement of a simplex sheet and feeds it back into the processor, but inverted, so that the appropriate data can be applied to the second side of the sheet. Known tri-roll inverters (U.S. Pat. Nos. 4,359,217; 4,346,880; and 4,673,176) for effecting this includes three rollers in frictional or geared contact with each other, to provide two spaced-apart nips, one being an input nip to an associated downstream sheet pocket, and the other being an output nip for extracting each sheet from the pocket. U.S. Pat. No. 3,416,791 shows a document inverting apparatus that includes a solenoid actuated rotating friction roller which projects into a chute and contacts rollers movable into the chute to hold the document in engagement with the friction roller. Other inverters of general interest are included in U.S. Pat. Nos. 4,928,127; 5,033,731; and European Patent Application Publication No. 0 402 836 A2.

A reversing roll nip is sometimes used to drive a sheet out of a tri-roll inverter because it provides positive sheet control at all times and is an active device, e.g., U.S. Pat. No. 5,317,377. The rolls are reversed by means of clutches or reversing motors. The productivity of any inverter design depends on the amount of sheet overlap that can occur inside the inverter. If sheet 2 can be inverting while sheet 1 is inverting, then the inverter is more productive than a single sheet only inverter. In a reversing roll design, the amount of overlap is determined by the distance between the input rolls, gating requirements, reversing roll and inverter roll speeds, and roll acceleration and deceleration times. The reversing roll distance from the input nip is determined by the shortest sheet process length the inverter is intended to handle. Typically, this is B5 paper length. For 11×17 inch papers, the overlap length remains the same and skipped pitches may be required to provide extra time for the longer sheets. The requirement is that the trail edge of sheet 1 has left the reversing roll nip before the lead edge of sheet 2 reaches the reversing roll nip. In order to obtain high productivity for all sheet lengths, the reversing roll nip may be placed on a slide to accommodate different paper lengths. The slide requires a separate motor, pulleys, switches or position sensors, and tensioning cables. Input of paper size is needed to move the slide the correct distance. The slide mechanism is expensive, cumbersome, and complicated. In addition, when there is a short paper path between the fuser and the inverter, the sheet must enter the inverter at process speed.

The present invention aims at providing an inverter designed to accomplish full productivity in low, medium or high volume copier/printers by moving sheets into and/or out of the inverter at process speed i.e., the speed at which the sheets are being processed or imaged and transported by the copier/printers.

SUMMARY OF THE INVENTION

Accordingly, the present invention provides a full productivity process speed inverter. The full productivity, tri-roll inverter includes a chute for accepting sheets therein; an input nip for driving sheets into the chute; an output nip for pulling sheets out of the chute; a reversing roll nip adapted to be opened or closed as required; and an actuator member connected to the reversing roll nip and adapted such that the reversing roll nip is open when the input nip is driving a sheet into the chute and closed for a predetermined period of time when the output nip is pulling a sheet out of the chute.

BRIEF DESCRIPTION OF THE DRAWINGS

The foregoing and other features of the instant invention will be apparent from a further reading of the specification, claims and from the drawings in which:

While the present invention will be described hereinafter in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

The invention will now be described by reference to a preferred embodiment of the inverter system of the present invention preferably for use in a conventional copier/printer. However, it should be understood that the sheet inverting method and apparatus of the present invention could be used with any machine in which inversion of a sheet is desired, be that sheet stacking or duplexing.

In general, an improvement to prior sheet inverter systems of machines is disclosed which is cost effective and comprises the use of a closely spaced input nip, output nip and dual positioning reversing roll nip inverter configuration.

Figure 1:
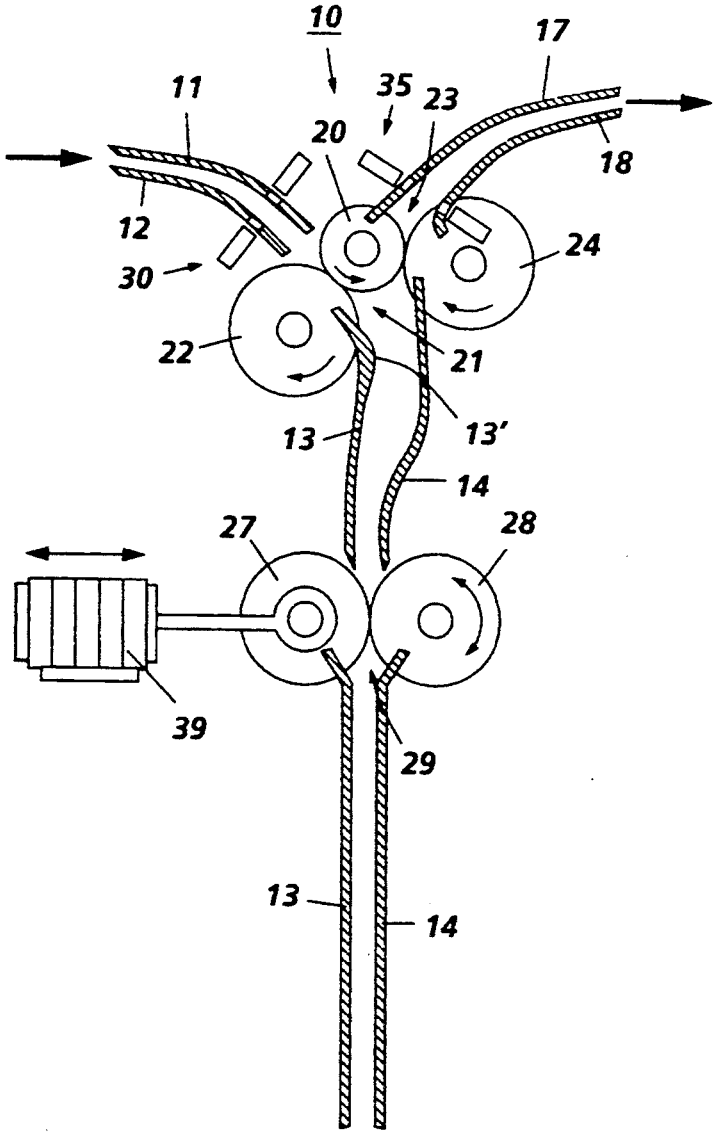
FIG. 1 is a schematic of the full productivity inverter according to the present invention.

As seen in FIG. 1, the full productivity, process speed, tri-roll inverter 10 of the present invention comprises baffles 11 and 12 that form a passageway for sheets to enter the inverter and a sensor 30 for detecting the lead and trail edges of sheets that have been conveyed past the sensor. Sensor 30 is conventional and can be of the optical sensing emitter and receiver variety. Idler roll 20 forms an input nip 21 with drive roll 22 for driving sheets into the inverter and an output nip 23 with drive roll 24 for driving sheets out of the inverter. Sheets captured by input nip 21 are driven through a chute formed between baffles 13 and 14 towards reversing roll nip 29 positioned within the chute and formed between idler roll 27 and drive roll 28. Idler roll 27 is movably connected to solenoid 39 and adapted to be moved from a nip forming position to an open nip, non sheet driving position. Solenoid 39 and reversing roll nip 29 are controlled by a conventional controller (not shown). Baffle 13 is configured with a hump 13' to assure proper exit of sheets out of the chute into output nip 23, i.e., deflect the trail edges of sheets toward baffle 14 and inline with output nip 23. Also, the common shaft of idler 20 is segmented for different input and output speeds of the sheets. Reversing roll nip 29 drives sheets into output nip 23 for transport past optional lead and trail edge optical sensor 35 into a path formed between baffles 17 and 18 and directed for further processing.

The reversing roll nip 29 is placed close to the tri-rolls, although it can be placed anywhere from the input nip to the shortest paper length, e.g., B5. The advantage to placing the reversing rolls 27 and 28 close to the input and output nips 21 and 23, respectively, is that the sheet is pulled out of the inverter as opposed to pushed out of the inverter as is done in some prior art devices. Also, the sheet beam length is short and moving the trail edge into the output nip 23 will be that much easier. The sheet beam length is very long in designs where the reversing roll or spring backstop is located at the end of the sheet which makes it harder to control the trail edge of the sheet. In addition, if it is close enough to the output nip, corrugation can be used in the reversing nip to aid in the inversion process. However, the reversing nip 29 needs to be placed far enough away from the incoming and exiting nips to allow enough time for the reversing sequence to take place within the intercopy gap. Therefore, the ideal location is a balance of these considerations.

Figure 2:
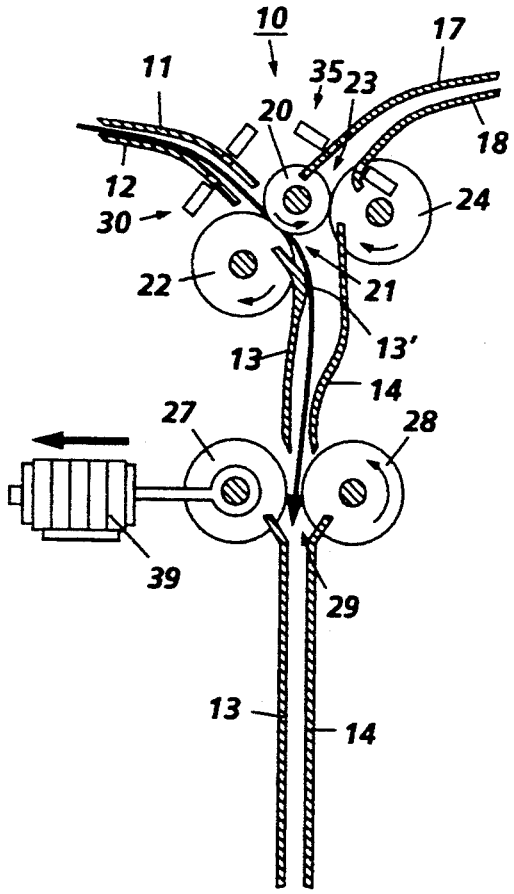
FIG. 2 is a schematic of the inverter of FIG. 1 at the start of a sheet inverting cycle with a first sheet being fed into the inverter by an input nip and a reversing roll nip positioned in an open position.
Figure 3:
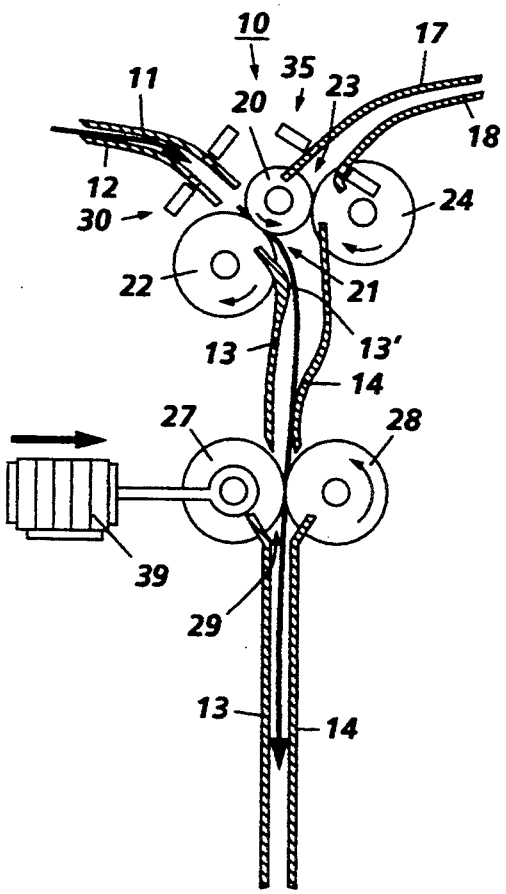
FIG. 3 is a schematic of the inverter of FIG. 2 showing the reversing roll nip closed and assisting the feeding of the first sheet into the inverter.
Figure 4:
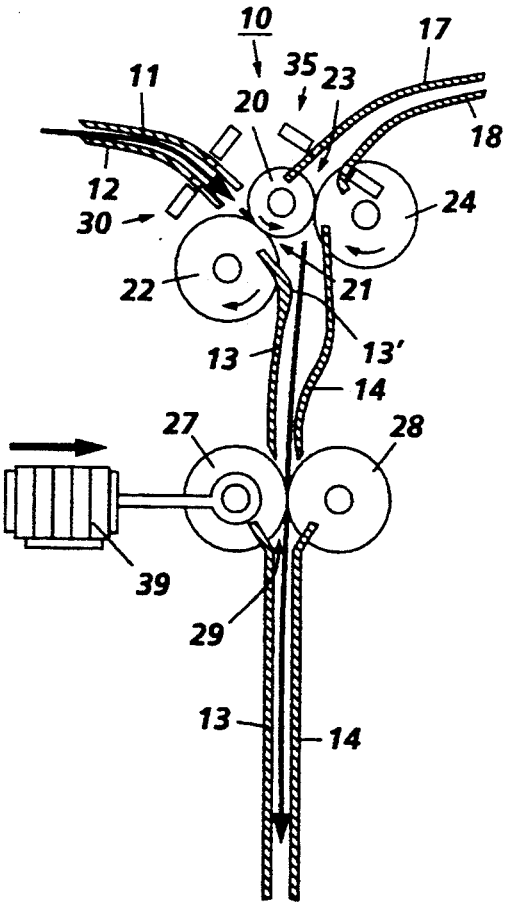
FIG. 4 is a schematic of the inverter of FIG. 3 showing the first sheet being reversed and fed into an output nip by the reversing roll nip.
Figure 5:
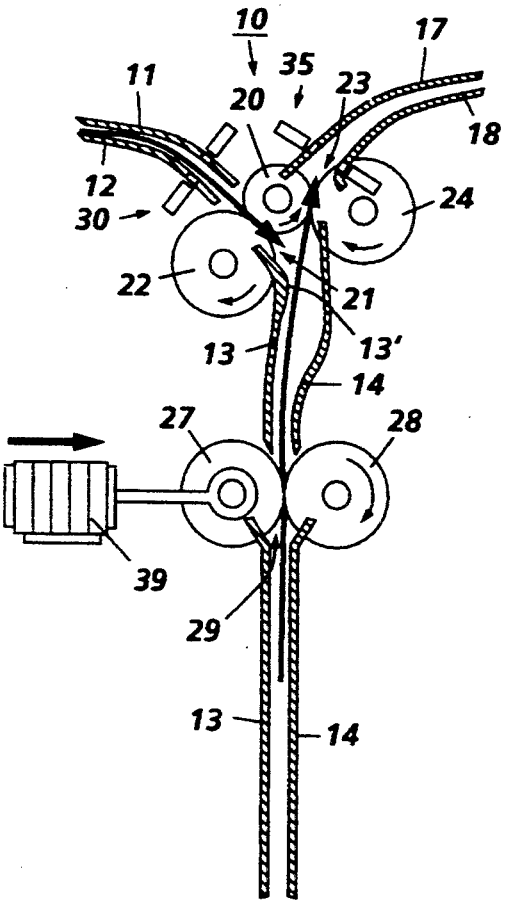
FIG. 5 is a schematic of the inverter of FIG. 4 showing a second sheet being fed into the inverter by the input nip while the reversing roll nip and output nip simultaneously feeds the first sheet out of the inverter.
Figure 6:
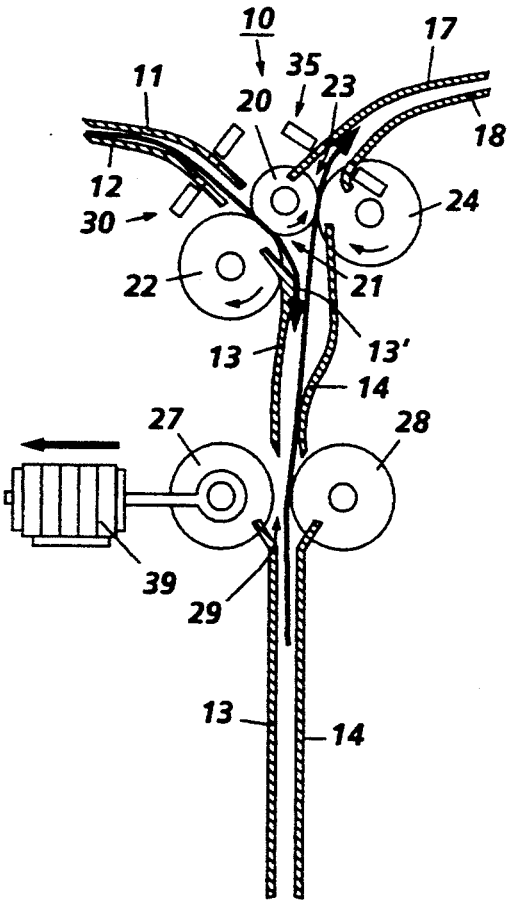
FIG. 6 is a schematic of the inverter of FIG. 5 showing the second sheet being fed into the inverter by the input nip with the reversing roll nip being in an open position and the output nip pulling the first sheet out of the inverter.
Figure 7:
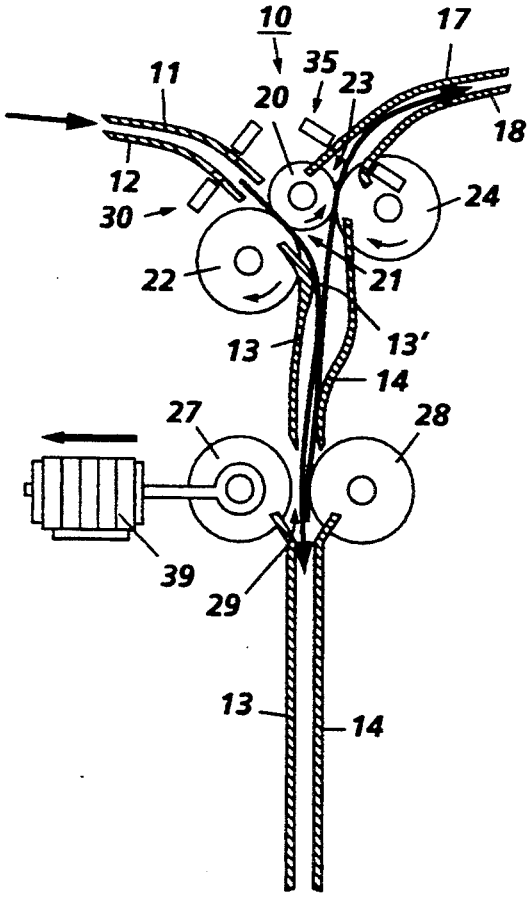
FIG. 7 is a schematic of the inverter of FIG. 6 showing a third sheet approaching the inverter while the second sheet is being fed into the inverter by the input nip with the reversing roll nip in an open position and the output nip pulling the first sheet out of the inverter.
Figure 8:
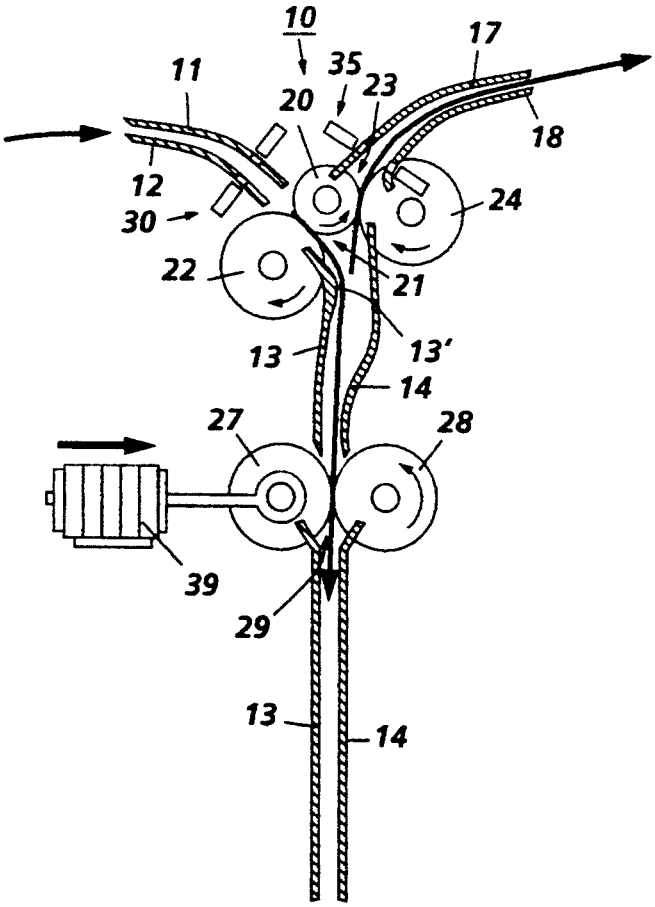
FIG. 8 is a schematic of the inverter of FIG. 7 showing the third sheet approaching the input nip of the inverter while the closed reversing roll nip assists in feeding the second sheet into the inverter while the output nip is pulling the first sheet out of the inverter.
Figure 9:
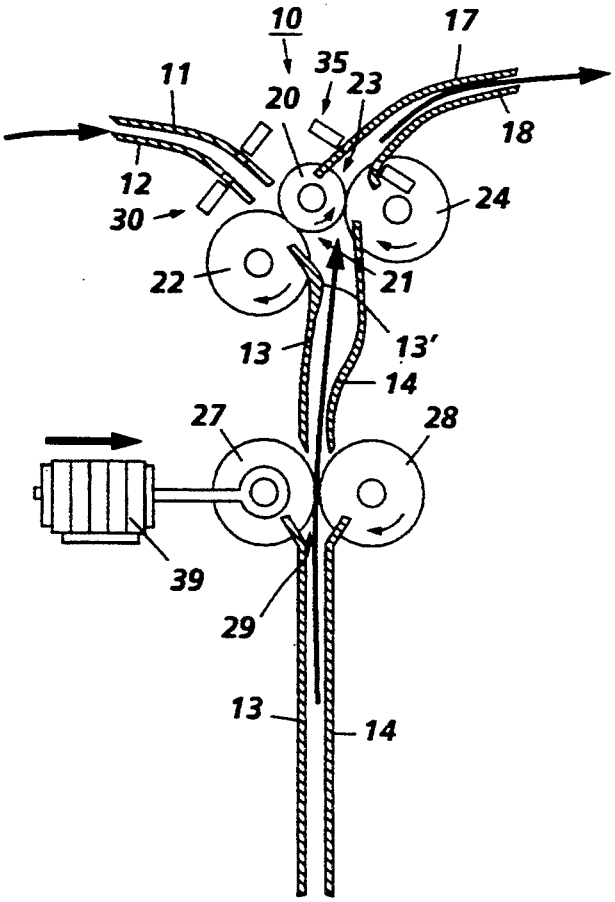
FIG. 9 is a schematic of the inverter of FIG. 8 showing the third sheet about to enter the input nip of the inverter while the closed reversing roll nip is driving the second sheet into the output nip of the inverter with the first sheet having exited the inverter.

As shown in FIGS. 2–9, the sheet inverting cycle starts in FIG. 2 with sheet 1 leaving, for example, the fuser of a conventional copier/printer (not shown), and being fed into the inverter by input nip 21 while reversing roll nip 29 is stationed in an open position by solenoid 39. In FIG. 3, now closed reversing roll nip 29 is assisting in the feeding of sheet 1 into the reversing chute (13, 14) while sheet 2 is approaching input nip 21. After sheet 1 is released by input nip 21 in FIG. 4, it is reversed by reversing roll nip 29 and fed into an output nip 23 by reversing roll nip 29. Sheet 2 is being fed into the inverter by the input nip in FIG. 5 while the reversing roll nip 29 and output nip 23 are simultaneously feeding sheet 1 out of the inverter. In FIG. 6, sheet 2 is being fed into the inverter by the input nip 21 with reversing roll nip 29 being in an open position and output nip 23 pulling sheet 1 out of the inverter. Sheet 3 is approaching the inverter in FIG. 7 while sheet 2 is being fed into the inverter by input nip 21 with reversing roll nip 29 being in an open position and the output nip 23 continuing to pull sheet 1 out of the inverter. In FIG. 8, sheet 3 is approaching input nip 21 of the inverter while now closed reversing roll nip 29 assists in the feeding the sheet 2 into the inverter and output nip 23 is pulling sheet 1 out of the inverter. FIG. 9 depicts sheet 3 about to enter input nip 21 of the inverter while closed reversing roll nip 29 is driving sheet 2 into output nip 23 of the inverter with the sheet 1 having exited the inverter.

Each sheet entering and exiting inverter 10 is controlled at all times by a hard nip. Sequentially, sheet 1 is controlled first by input nip 21; then by input nip 21 and reversing roll nip 29; then only by reversing roll nip 29; then by reversing roll nip 29 and output nip 23; then only by output nip 23. At no time is the sheet free-falling or out of control of the nips. Sensor 30 just upstream of input nip 21 detects sheet 1 moving into the inverter. By the time the lead edge of sheet 1 reaches reversing nip 29, the nip is already open because a previous sheet is moving out of the inverter. Sheet 1 travels through the open reversing roll nip and into the inverter baffle portion below the reversing roll nip. After a fixed time determined by when the trail edge clears the input nip, reversing roll nip 29 reverses and sends sheet 1 into the output nip 23. Another sensor 35 can be placed just downstream of the output nip 23 and adapted such that when the lead edge of sheet 1 is detected, the reversing roll nip 29 is opened up. This is accomplished by using a solenoid 39 to open up the nip, or other direct mechanical linkage; for instance, a rocker arm attached between rolls and 28 which opens up the nip whenever there is a sheet traveling through output nip 23. In lieu of sensor 35 downstream of the output nip, a stepper motor can be used. The requirement is that the reversing roll nip 29 be open at the time the lead edge of sheet 2 reaches it so that both sheets can move by each other in the inverter. The sheets are overlapped at this time and continue to overlap as sheet 1 moves out of the inverter while sheet 2 moves in. The overlap amount is close to the entire sheet length for all sheet lengths with this inverter. The vertically fixed positioned reversing roll nip 29 has a fixed amount of overlap which is the same for all sheets. Here, the overlap is maximized for all sheets sizes without a slide mechanism. Also, output nip 23 can be moving at 1.5 to 2.0 times the process speed at which the incoming nip 21 rotates. This enables the sheet to be resynchronized with the process loop of the copier/printer with which it is used. This also ensures that sheet 1 will be out of the reversing roll nip well before the reversing roll nip needs to close to reverse sheet 2.

As described above in detail, the inverter of the present invention enables full productivity for all sheet sizes without the use of complicated slide mechanisms. The sheet is controlled at all times by at least one nip roll pair. Sheet reversal is accomplished by using a reversing roll nip. The reversing roll nip closes while rotating in a forward direction before the trail edge of sheet 1 leaves the input nip 21. The reversing roll nip idler 27 closes in the forward direction before sheet 1 trail edge leaves the input nip 21. The reversing roll nip 29 then reverses sheet 1 so that sheet 1 moves into output nip 23. Then the reversing roll nip opens up to allow overlapping of exiting sheet 1 and entering sheet 2. The reversing roll nip closes again to control sheet 2 and reverse it. The simple addition of a solenoid and/or linkages greatly increases the throughput of the basic reversing roll design. This offers a cost effective alternative to the conventional method of accelerating the sheets to increase the intercopy gap and is particularly beneficial in copier/printers with short paper paths.

Figure 10:
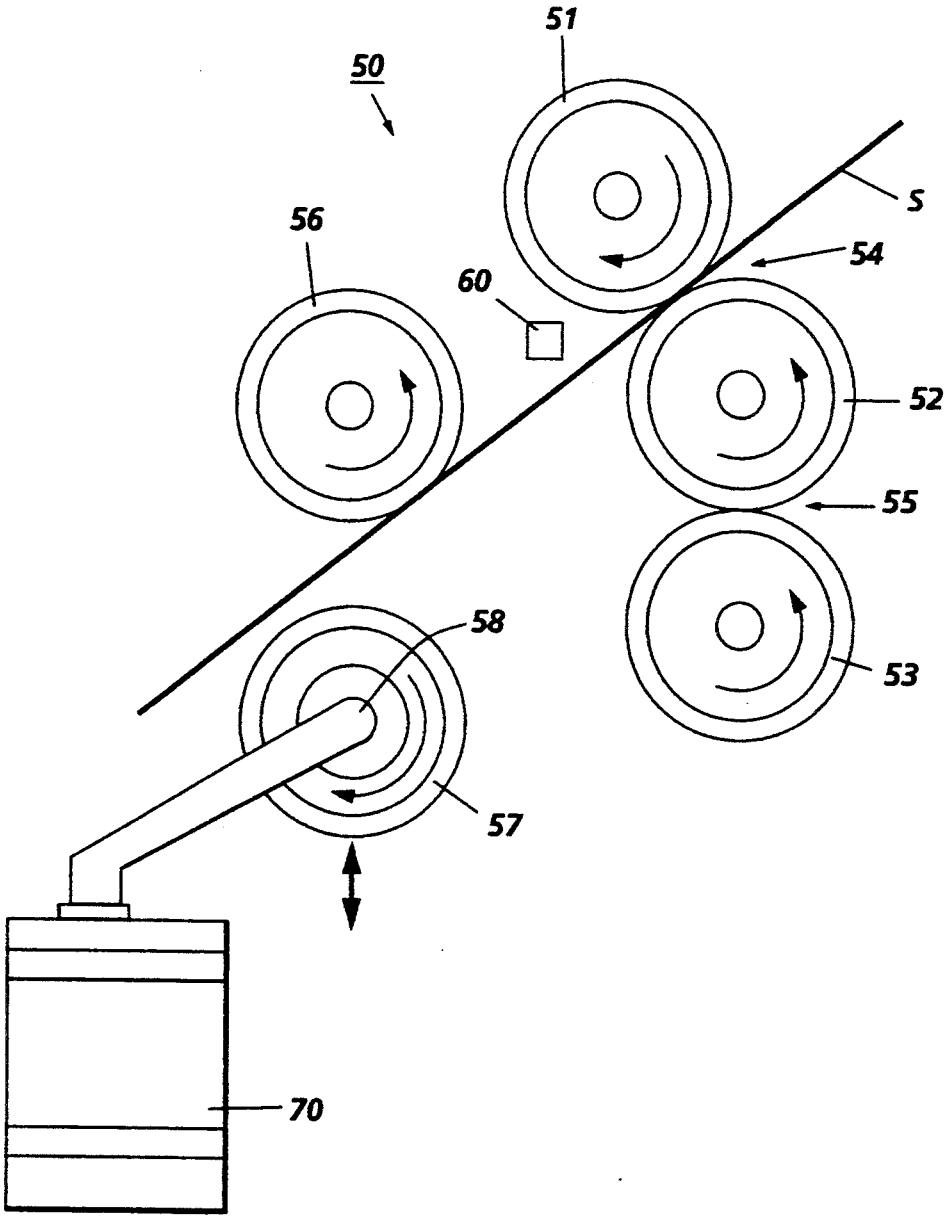
FIG. 10 is a schematic of a simplified reversing inverter embodiment in accordance with the present invention.

An alternative embodiment of a simplified reversing inverter configuration 50 is disclosed in FIG. 10 which is active, highly reliable and does not require reversing motors or clutches. It comprises tri-rolls 51, 52 and 53 that form input nip and output nips 54 and 55, respectively. A sensor 60 is positioned immediately downstream of input nip 54. Constantly rotating reversing rolls 56 and 57 are closely spaced with respect to the input and output nips with drive roll 57 being mounted on a shaft 58 that is rotated by a belt (not shown) in a clockwise direction. A solenoid 70 is linked to shaft 58 in order to open and close the reversing rolls as needed.

In operation, sheet sensor 60 senses the presence of a sheet S and produces a high signal level to the solenoid 70. Conversely, with no sheet being present, a low signal is sent to the solenoid. When the sensor signal transitions from low to high, this indicates the lead edge of sheet S has been sensed. At this point, the reversing rolls are open to provide clearance for the incoming sheet. This is accomplished by deactivating the solenoid. The solenoid plunger is attached to a linkage which is attached to shaft 58 of reversing roll 57. The nip between the two reversing rolls 56 and 57 is opened and the sheet is allowed to pass through. As the sheet passes through the input nip 54, the sheet sensor transitions from high to low, indicating the trail edge of the sheet. At this time, the reversing roll nip needs to be closed so that the sheet can be sent in the reverse direction into output 55. The sheet trail edge becomes the lead edge when the sheet velocity is reversed. The reversing nip is closed by activating the solenoid. The reversing nip remains open during the entire time the sheet is in the input nip 54. Since there is only a 1.5 inch intercopy gap for $8.5\times11$ inch sheets, the solenoid is activated only for $1.5\div(1.5+8.5)=15\%$ of the time. All nips are set to the same speed and the reversing rolls are placed the shortest distance required to span the shortest sheet between the trirolls and the reversing rolls.

Overlap inverting can be accomplished with this inverter by simply having a timing requirement, for example, that specifies that sheet 1 be 5 mm into the output nip 55 before sheet 2 can enter the input nip. At that point, sheet 2 can feed in to greater productivity. During overlap inverting, sheet 1 is controlled by the output nip, sheet 2 is controlled by the input nip, and the reversing nip is open.

Figure 11:
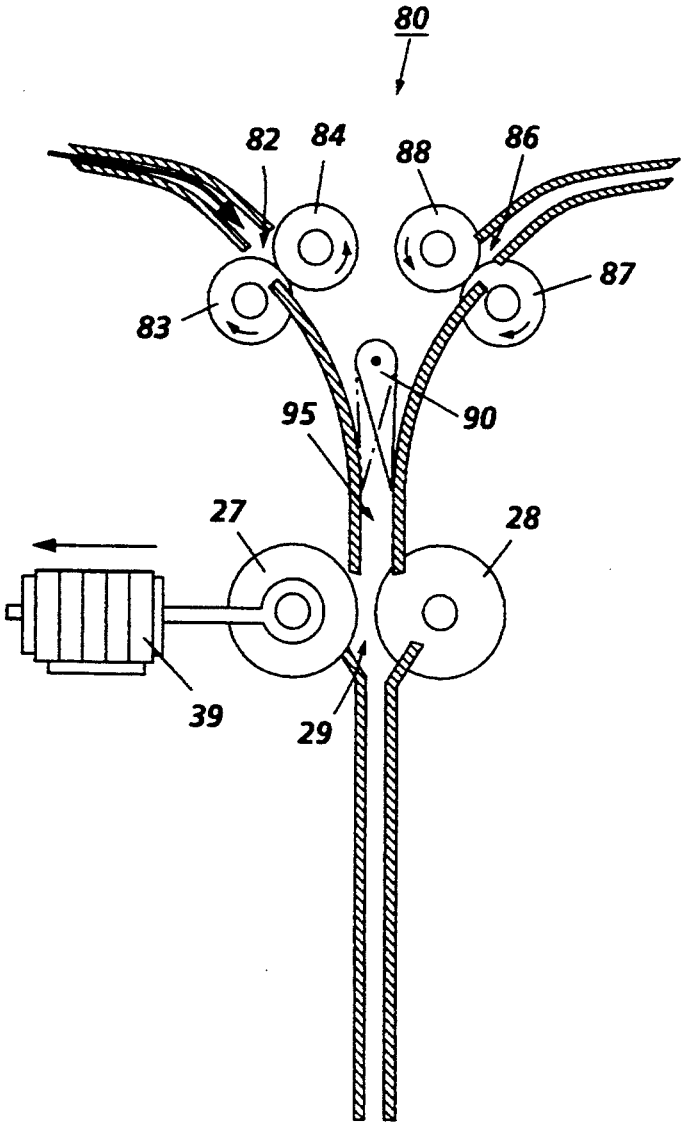
FIG. 11 is a schematic of another alternative embodiment of a simplified reversing inverter in accordance with the present invention that includes separate input and output nips.

Another alternative embodiment 80 of the inverter of the present invention is shown in FIG. 11 that includes separate sheet input and output nips 82 and 86, respectively, which are comprised of rollers 83 and 84 for input nip 83 and rollers 87 and 88 for output nip 86. A gate 90 deflects sheet into and out of inverter channel 95. The sheets are driven out of channel 95 into output nip 86 by reversing roll nip 29 that includes idler roll 27 that is positioned by solenoid 39 and drive roll 28. Each sheet is controlled at all times by at least one nip roll pair. Sheet reversal is accomplished by using the reversing roll nip. The reversing roll nip closes while rotating in a forward, incoming sheet direction before the trail edge of sheet 1 leaves the input nip 82. The reversing roll nip idler 27 closes in the forward direction before sheet 1 trail edge leaves the input nip 82. The reversing roll nip 29 then reverses sheet 1 so that sheet 1 moves into output nip 86. Then the reversing roll nip opens up to allow overlapping of exiting sheet 1 and an entering sheet 2. The reversing roll nip closes again to control sheet 2 and reverse it.

It is, therefore, evident that there has been provided in accordance with the present invention an inverter apparatus for copiers/printers or the like which serves to reverse lead and trail edges of a sheet at process speed thereby fully satisfying the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

What is claimed is:

1. A full productivity, tri-roll inverter, comprising:

a chute for accepting sheets therein;

an input nip for driving sheets into said chute, and wherein said sheets are driven into said chute by said input nip at process speed of a machine into which the sheets are processed;

an output nip for pulling sheets out of said chute at said machine process speed, said input and output nips including a common idler roll that mates with input and output drive rolls to form said input and output nips;

a reversing roll nip adapted to be opened or closed as required; and an actuator member connected to said reversing roll nip and adapted such that said reversing roll nip is initially open when said input nip is driving a sheet into said chute and, then closed and driven in a first direction to assist said input nip in driving the sheet further into said chute, then reversed and driven in a second and opposite direction after the sheet is released by said input nip to drive the sheet into said output nip and assist said output nip in driving the sheet out of the inverter, and subsequently opened again as said input nip drives another sheet into said chute.

2. The tri-roll inverter of claim 1, wherein said input nip drives a first sheet into said chute while said output nip simultaneously drives a second sheet out of said chute.

3. The full productivity, tri-roll inverter of claim 1, wherein sheets are driven out of said chute at said process speed of said machine.

4. The full productivity, tri-roll inverter of claim 1, wherein said output nip is driven at a speed different from that of said input nip.

5. The tri-roll inverter of claim 1 wherein said chute includes a baffle that is configured with a hump to assure proper exit of sheets out of said chute into said output nip.

6. The tri-roll inverter of claim 1, wherein said common idler roll is mounted on a shaft, and wherein said shaft is segmented to accommodate different input and output speeds of the sheets.

7. A method for obtaining full productivity with a tri-roll inverter, comprising the steps of:

providing a chute for accepting sheets therein;

driving sheets into said chute with an input nip;

pulling sheets out of said chute with an output nip;

positioning a reversing roll nip downstream of said input and output nips;

providing an actuator member connected to said reversing roll nip that is adapted to initially open said reversing roll nip when said input nip is driving a sheet into said chute, close said reversing roll nip after the sheet has partially past between said open reversing roll nip and rotating said reversing roll nip in a predetermined direction in order to assist said input nip in driving the sheet into said chute;

reversing said predetermined direction of rotation of said reversing roll nip to drive the sheet into said output nip; and opening said reversing roll nip when said output nip is pulling a sheet out of said chute.

8. The method of claim 7, including the step of rotating said input nip at a first speed while simultaneously driving said output nip at a second speed.

9. The method of claim 7, including the step of driving the sheets into said chute at process speed of a machine into which the sheets are processed.

10. The method of claim 9, including the step of driving the sheets out of said chute at machine process speed.

11. The method of claim 7, including the step of driving said output nip at a speed different from that of said input nip.

12. The method of claim 7, including the step of providing means other than said input nip for directing trail edge of the sheet into said output nip.

13. A tri-roll inverter apparatus for positioning in the paper path of a copier/printer having an input nip and an output nip for feeding sheets into and out of a first portion of a sheet reversing chute and a dual position reversing roll nip positioned in a second portion of the sheet reversing chute and in close proximity to the input and output nips to reverse the lead and trail edge orientation of the sheets, the improvement comprising:

a dual positioning actuator member connected to said reversing roll nip and adapted when in a first of said dual positions to initially open said reversing roll nip for a predetermined time while said input nip is driving a first sheet into said reversing chute and actuated to a second of said dual positions to close said reversing roll nip while said input nip is driving said first sheet into said sheet reversing chute, said reversing roll nip being rotated in a given direction to assist said input nip in driving said first sheet into said reversing chute and to reverse its direction of rotation to drive said first sheet into said output nip once said first sheet is released by said input nip, and wherein said actuator member is adapted to open said reversing roll nip when said output nip is pulling said first sheet out of said sheet reversing chute, and wherein said input nip is adapted to drive a second sheet into said sheet reversing chute once said first sheet is captured by said output nip to thereby accomplish simultaneous inversion of said first and second sheets within said sheet reversing chute.

14. The inverter apparatus of claim 13, wherein sheets are driven into said sheet reversing chute at process speed of the copier/printer in order to obtain full productivity.

15. The inverter apparatus of claim 14, wherein sheets are driven out of said sheet reversing chute at said process speed of the copier/printer.

16. The inverter apparatus of claim 13, wherein said output nip is driven at a speed different from that of said input nip in order to match paper path timing requirements.

17. The tri-roll inverter of claim 13, wherein said chute includes a baffle that is configured with a hump to assure proper exit of sheets out of said chute into said output nip.

* * * * *